United States Patent [19]

Billoud et al.

[11] Patent Number: 4,817,806

[45] Date of Patent: Apr. 4, 1989

[54] BOTTLE WITH ROUNDED BOTTOM FITTED WITH A BASE AND PROVIDED WITH A PASSAGE FOR A HEAT-EXCHANGE FLUID AND BASE FOR SAME

[75] Inventors: Alain Billoud, Meaux; Victor Lorin, Trilport; Alain Vanney, Chambry par Varreddes, all of France

[73] Assignee: Carnaud Kerplas, Meaux, France

[21] Appl. No.: 943,025

[22] Filed: Dec. 18, 1986

[30] Foreign Application Priority Data

Dec. 19, 1985 [FR] France ..... 85 18839

[51] Int. Cl.[4] ..... B65D 23/00; B65D 25/24

[52] U.S. Cl. ..... 215/12.1; 215/100 R; 220/69; 248/346

[58] Field of Search ..... 215/1 R, 1 C, 12 R, 215/100 R, 12.1; 220/69, 428; 248/346, 346.1, 359 E

[56] References Cited

U.S. PATENT DOCUMENTS

| | | | |
|---|---|---|---|
| 3,143,243 | 8/1964 | MacKusick | 220/69 |
| 3,482,724 | 12/1969 | Heaton | 215/100 R X |
| 3,809,353 | 5/1974 | Good et al. | 248/346.1 |
| 3,840,141 | 10/1974 | Allom et al. | 220/69 X |
| 3,927,782 | 12/1975 | Edwards | 215/100 R |
| 4,082,200 | 4/1978 | Guest et al. | 215/12 R X |
| 4,196,039 | 4/1980 | Jakobsen | 156/580 |
| 4,241,893 | 12/1980 | Alberghini | 215/100 R |
| 4,293,359 | 10/1981 | Jakobsen | 156/156 |

FOREIGN PATENT DOCUMENTS

| | | | |
|---|---|---|---|
| 1335913 | 7/1963 | France . | |
| 2276998 | 1/1976 | France . | |
| 2351020 | 12/1977 | France . | |
| 658042 | 4/1979 | U.S.S.R. | 220/69 |
| 688150 | 2/1953 | United Kingdom | 248/346 |

*Primary Examiner*—Sue A. Weaver

*Attorney, Agent, or Firm*—Sughrue, Mion, Zinn, Macpeak, and Seas

[57] ABSTRACT

A bottle has a rounded bottom, a lateral wall and a separate base. The base comprises a lateral wall which surrounds and is fixed to a lower portion of the lateral wall of the bottle. It also comprises an annular support boss and a bottom part comprising an area supporting the bottom of the bottle. The bottle comprises a passage for a heat exchange fluid. This passage includes inlet and outlet areas for the heat exchange fluid. The flow of the fluid through the passage passes across part of the bottom of the bottle. This facilitates effective pasteurization or deep-freezing of the bottle's contents.

23 Claims, 2 Drawing Sheets

BOTTLE WITH ROUNDED BOTTOM FITTED WITH A BASE AND PROVIDED WITH A PASSAGE FOR A HEAT-EXCHANGE FLUID AND BASE FOR SAME

BACKGROUND OF THE INVENTION

1. Field of the invention

The present invention concerns a bottle with a rounded bottom fitted with a base and especially bottles of this kind intended to be subjected to pasteurization, deep-freezing and like processing using a heat-exchange fluid.

Such bottles are specifically designed for use in the foodstuffs, pharmaceuticals, industrial and like domains.

2. Description of the prior art

The bases usually used in association with round-bottomed bottles enable them to remain stable when stood on a support.

However, when a bottle of this kind contains a fluid to be pasteurized, there is observed during the pasteurization process a difference in temperature between the liquid in the part of the bottle above the base and the liquid in the part of the bottle surrounded by the base. The base acts as a insulator at the bottom of the container and the fluid at this level does not receive the same quantity of heat from a heat exchange fluid as that in the part of the bottle above the base. This constitutes a major disadvantage when such bottles are pasteurized because it is then necessary to extend the heating and/or cooling period in such a way as to obtain the required temperature. This entails the expenditure of additional energy and the overall cost of the operation is thereby significantly increased.

The objective of the present invention is to alleviate this disadvantage by providing a bottle provided with a passage for heat exchange fluid between the bottle and its base so as to improve the transfer of heat between the heat exchange fluid and the liquid contained in the bottle and especially the liquid in the part of the bottle surrounded by the base.

SUMMARY OF THE INVENTION

In one aspect the present invention consists in a bottle suitable for processing by means of a heat exchange fluid, as by pasteurization or the like, comprising a separate base attached to it and, between said base and the body of the lower part of the bottle, a passage for heat exchange fluid communicating with the exterior and having an inlet area and an outlet area.

In a second aspect the present invention consists in a bottle having a rounded bottom and a lateral wall and comprising a separate base attached to it and having a lateral wall surrounding and fixed to a lower portion of said lateral wall of said bottle, an annular support boss, and a bottom part comprising an area supporting the bottom of said bottle, the bottle further comprising, between said base and the body of the bottle, a passage for heat exchange fluid communicating with the exterior via an inlet area and an outlet area, the fluid passing over part of the bottom of the bottle as it flows through said passage.

In a third aspect, the present invention consists in a base for a container having a rounded bottom and a lateral wall, comprising a lateral wall adapted to surround and to be fixed to a lower portion of said lateral wall of said container, an annular support boss, a bottom part comprising an area adapted to support the bottom of said container, and inlet and outlet areas for a heat exchange fluid in said base arranged so that a flow of said fluid through said base passes across the bottom of said container.

By virtue of these provisions the bottle or the base for same facilitates the flow of a heat exchange fluid in contact with the lower part of the bottle and therefore improves the transfer of heat between the heat exchange fluid and the substance contained in the bottle. It is therefore possible to reduce the time for which the container is held at a particular temperature during any form of pasteurization, deep-freezing or like process.

Other objectives, characteristics and advantages of the invention will emerge from the following description given by way of example with reference to the appended drawings.

DESCRIPTION OF THE PREFERRED EMBODIMENTS

Figure 1:
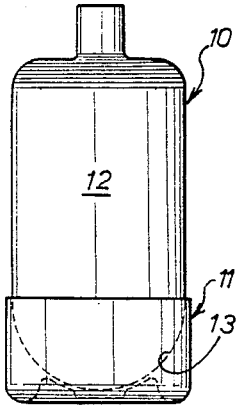
FIG. 1 is a view in elevation of a bottle and its base, the bottle being provided with a heat exchange fluid passage, constituting a first embodiment of the invention.

Each of the two embodiments to be described provides a heat exchange fluid passage between a bottle and its base.

In the embodiment shown in FIGS. 1 through 4 a bottle or container 10 is fitted with a base 11. The bottle 10, which is known per se, contains any liquid 12 to be pasteurized and has a rounded bottom 13 and a cylindrical lateral wall 14. The base is in the form of a cup having a bottom part, a support boss 17 and a cylindrical lateral wall 16. The bottom part consists of a central part 15 spaced from the bottom of the bottle 10 and surrounded by an annular curved area 23 defining a support and centering area for the rounded bottom of the container 10.

The annular support boss 17 is pierced at its end by a plurality of orifices 18 constituting a fluid outlet. These orifices are circumferentially distributed and spaced from a bearing area 30 of the boss.

The lateral wall 16 of the base has in its upper part the annular fixing area 19 provided with a plurality of axially oriented recesses 20.

A passage 50 for heat exchange fluid is defined by the wall of the bottle between the fixing area 19 and the support area 23, on the one hand, and the wall of the base facing this wall, on the other hand.

Figure 2:
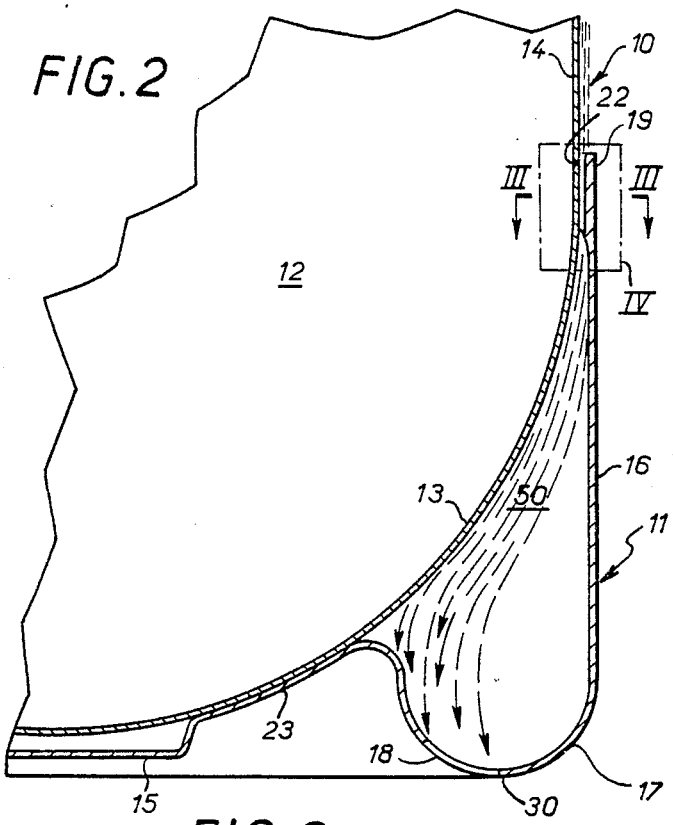
FIG. 2 is a partial view to a larger scale and in longitudinal cross-section of a bottle fitted with a base in accordance with a first embodiment of the invention.
Figure 4:
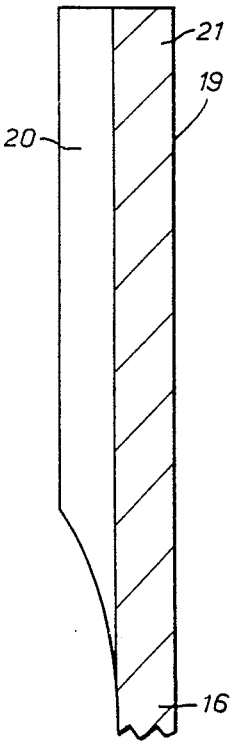
FIG. 4 is a view to a larger scale of the detail marked IV in FIG. 2.
Figure 3:
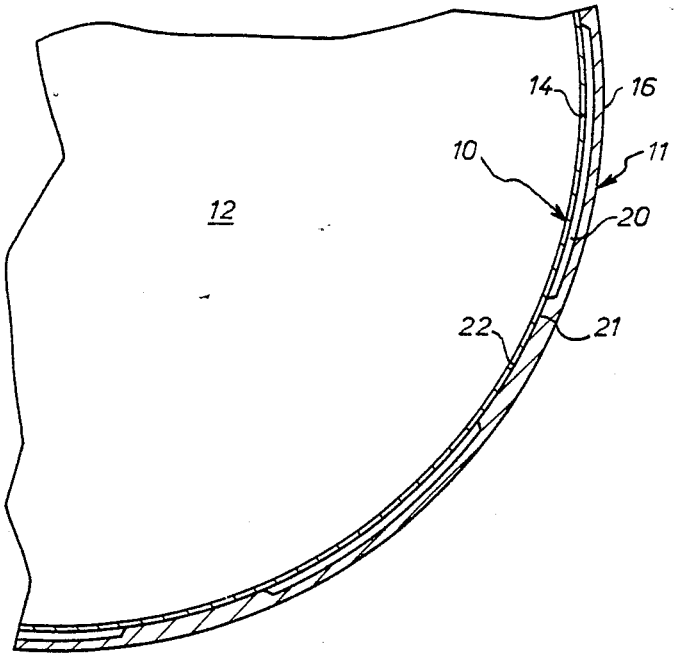
FIG. 3 is partial view in cross-section on the line III—III in FIG. 2.

As can be seen better in FIGS. 2 and 3, the recesses 20 alternate circumferentially with reinforcements 21 forming an integral part of the lateral wall 16.

A base of this kind is designed to cap the lower part of the bottle 10 and thus to cover its bottom.

The fixing area 19 cooperates with the support area 23 to hold the bottle 10 in a vertical position and center it within the base.

The lateral wall 16 is thicker at this point in order to reinforce the fixing area 19, to make it mechanically stronger.

The fixing area 19, more specifically the surface 22 of the reinforcements 21, is designed to come into contact with the lateral wall 14 of the bottle. This contact is generally strengthened by adhesive bonding, welding, clipping or interference fit means.

When the container provided with a heat exchange fluid passage in accordance with the invention is subjected to a pasteurization process, for example, a heat exchange fluid flows along the wall 14 of the bottle, enters the passage 50 through the recesses 20, flows along the wall of the bottle between the fixing area 19 and the bottle support area 23, separates from the bottom 13 of the bottle, falls into the boss 17 and is then evacuated from the passage 50 through the orifices 18.

Thus the part of the wall 14 of the bottle between the fixing area 19 and the support area 23 and surrounded by the base is directly in contact with the heat exchange fluid, which enables the transfer of heat to the liquid in the bottom of the bottle to be substantially increased.

Note that the fact that the base just described is hollow and that its lateral wall 16 is spaced from the wall 14 of the bottle 10 enables good circulation of the heat exchange liquid, which is not impeded at the points of evacuation since the outlet orifices 18, although situated in the lowest part of the support boss 17, are not closed off when the bottle is resting on a support. The heat exchange fluid can therefore be circulated in a continuous way. To permit more effective circulation of the heat exchange liquid over the bottom of the bottle 10 the total cross-section of the orifices 18 in the base is greater than or equal to the total cross-section of the recesses 20.

Note that the base fitted with a corresponding bottle may be subjected to other processes than pasteurization, such as deep-freezing, for example.

Although the surface 22 of the reinforcements 21 of the base as previously descirbed is in direct contact with the cylindrical wall 14 of the bottle there is no significant insulative effect near the contact area since this is small and does not significantly affect the distribution of heat within the liquid contained in the bottle 10.

The heat exchange fluid passage in accordance with the invention may also be formed not by adapting the base but by adapting the bottom of the bottle itself, as in the second embodiment of the present invention described hereinafter.

Parts that are identical or have an analogous function in the two embodiments have reference numbers differing by the addition of a hundreds digit.

Figure 5:
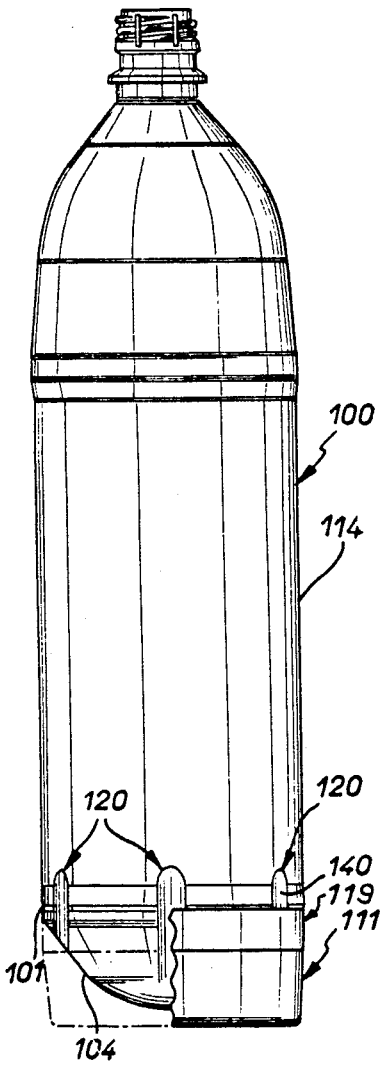
FIG. 5 is a partially cut away view in elevation of a bottle and its base having a heat exchange fluid passage, constituting a second embodiment of the invention.
Figure 6:
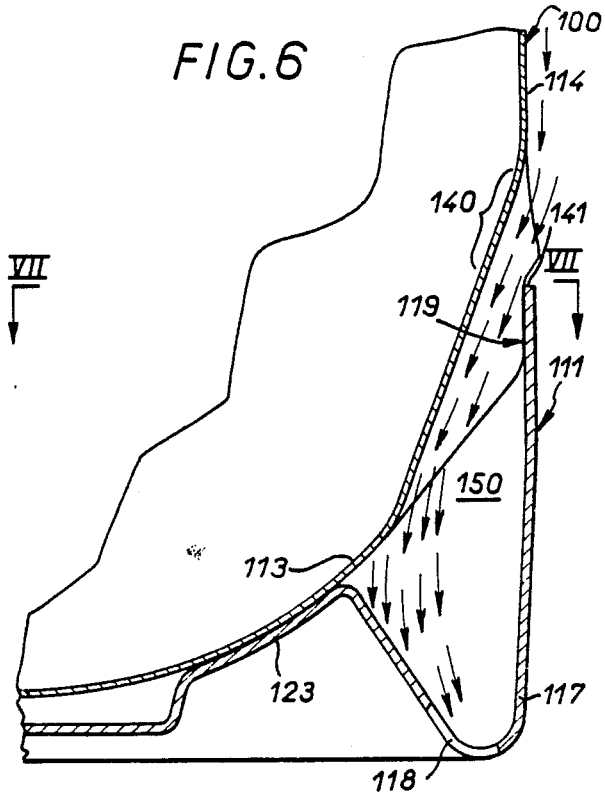
FIG. 6 is a view in cross-section and to a larger scale of part of the bottle and base shown in FIG. 5.
Figure 7:
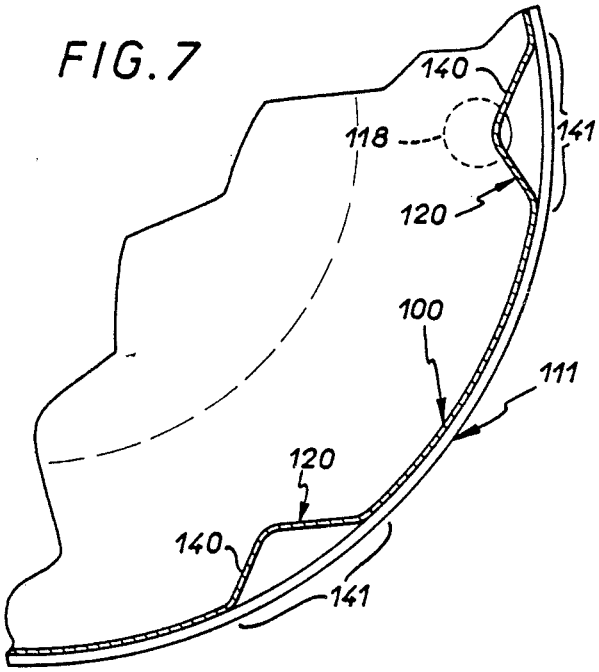
FIG. 7 is a view in cross-section of the line VII—VII in FIG. 6.

As shown in FIGS. 5 through 7, a bottle 100 is formed with longitudinal recesses 120 in its lower part. These recesses extend between a cylindrical area 114 and a rounded area 104 of the bottle and through an annular area 119 in which a base 111 is fixed to the bottle.

The lower part of the bottle is further provided with a circumferential shoulder 101 defining a bearing area for the base 111, of known type, designed to cover the rounded bottom of the bottle and to be fixed to the bottle 100 through the intermediary of the annular fixing area 119. The base 111 comprises a member support boss 117 having a plurality of orifices 118 analogous to the plurality of orifices 18 in the first embodiment. This plurality of orifices 118 constitutes a fluid outlet area. Once fitted onto the bottle and fixed to it by any appropriate means (by adhesive bonding in particular), the recesses 120 have an upper part 140 situated above the junction of the base with the bottle.

There is thus created a passage 150 for a heat exchange fluid the inlet area of which is defined between the upper part 140 of the recess 120 and the part of the upper edge 141 of the base facing the recess 120.

The heat exchange fluid passge 150 extends from the inlet area along the recess 120 and then along part of the bottom 113 of the bottle, as far as the outlet area 118.

Note that the recesses 120 formed in the bottle 100 are easier to produce (as they are formed when the bottle is blown) than the recesses 20 in the thickness of the annular fixing area of the base in the first embodiment.

Note also that the total area of the heat exchange fluid passage inlet area is greater in the second embodiment than in the first embodiment.

The recesses 120 in the bottle constitute re-entrant areas the radial dimension of which is greater than or equal to several times the thickness of the base of the first embodiment. As the recesses formed in the base in the first embodiment are necessarily limited to a fraction of the total thickness of the wall of the base, in order for this wall to have sufficient mechanical strength, these recesses 20 necessarily constitute an inlet area of limited surface area.

It is also possible to increase the inlet area by providing recesses that are deeper in the radial direction, without this reducing the circumferential extend between the fixing areas and the cylindrical part of the lateral wall of the bottle.

Note also that since the total area of the inlet area in the second embodiment is greater than the total area of the inlet area in the first embodiment, the flowrate and circulation of the heat exchange fluid are enhanced in the second embodiment.

However, both of the two embodiments described provide a passage for a heat exchange fluid between a bottle and a base to improve the transfer of heat between the heat exchange fluid and the substance contained in the bottle.

In a third embodiment (not shown) the heat exchange fluid passage has, in addition to an outlet area formed in the base, an inlet area also formed in the base of the bottle but short of its fixing area.

In a variant that is not shown the outlet area of the heat exchange fluid passage is formed in the central part 15 of the base and recesses as described for the second embodiment are formed in the bottom part 113 facing the support area 123 to permit circulation of the heat exchange fluid. These recesses can likewise be formed in the support area of the base. These modifications may be incorporated in any of the embodiments previously described and offer the advantage of increasing the area of contact between the heat exchange fluid and the bottom of the bottle.

The present invention also encompasses all variants within the competence of those skilled in the art, such as, for example, the adaptation of a heat exchange fluid passage of this kind to polygonal containers, or plastics material and/or metal barrels.

There is claimed:

1. A bottle suitable for processing by means of a heat exchange fluid, as by pasteurization or the like, comprising a bottle body and a separate base attached to the body, and, between said base and a lower part of the bottle body, means defining a passage for heat exchange fluid running over a substantial part of the bottom of the bottle body from an inlet area for entering heat exchange fluid to an outlet area for exiting heat exchange fluid, said inlet and outlet areas being substantially spaced from each other, and said inlet and outlet areas being in substantially longitudinally spaced relation relative to the axis of the bottle body.

2. A bottle comprising: a bottle body having a rounded bottom and a lateral wall; and a separate base attached to the bottle body and having a lateral wall surrounding and fixed to a lower portion of said lateral wall of said bottle body, an annular support boss, and a bottom part comprising a support area supporting the bottom of said bottle body; the bottle further comprising, between said base and the body of the bottle, means defining a passage for heat exchange fluid running over a substantial part of the bottom of the bottle body from an inlet area, for entering heat exchange fluid, to an outlet area, for exiting heat exchange fluid, said inlet and outlet areas being substantially spaced from each other, and said inlet and outlet areas being in substantially longitudinally spaced relation relative to the axis of the bottle body.

3. A bottle according to claim 2, wherein said inlet area comprises a plurality of circumferentially distributed, axially oriented recesses.

4. A bottle having a rounded bottom and a lateral wall and comprising a separate base attached to it and having a lateral wall surrounding and fixed to a lower portion of said lateral wall of said bottle, an annular support boss, and a bottom part comprising a support area supporting the bottom of said bottle, the bottle further comprising, between said base and a body of the bottle, a passage for heat exchange fluid communicating with the exterior via an inlet area and an outlet area, said fluid passing over part of the bottom of the bottle as it flows through said passage, said inlet area comprising a plurality of circumferentially distributed, axially oriented recesses, and said outlet area comprising a plurality of circumferentially distributed orifices in said support boss.

5. A bottle according to claim 4, further comprising a fixing area and wherein said support boss comprises a bearing area and extends between said support area and said fixing area, said plurality of orifices extending beyond said bearing area.

6. A bottle according to claim 5, wherein said axially oriented recesses are all in said lateral wall of said base and pass through an area of greater thickness than the remainder of said lateral wall of said base.

7. A bottle according to claim 6, wherein the total cross-section of said recesses is less than the total cross-section of said orifices.

8. A bottle according to claim 6, wherein said support area comprises an annular curved area adapted to lie against the bottom of said bottle and to center said bottle relative to the base.

9. A bottle according to claim 2, further comprising longitudinal recesses extending through an annular area by which said base is fixed to the bottle body and wherein said means for defining a passage includes said recesses.

10. A bottle having a rounded bottom and a lateral wall, and comprising a separate base attached to it and having a lateral wall surrounding and fixed to a lower portion of said lateral wall of said bottle, an annular support boss, and a bottom part comprising an area supporting the bottom of said bottle; the bottle further comprising: between said base and the body of the bottle, a passage for heat exchange fluid communicating with the exterior via an inlet area and an outlet area, said fluid passing over part of the bottom of the bottle as it flows through said passage; and longitudinal recesses extending through an annular area by which said base is fixed to the bottle: said heat exchange fluid passage being formed by said recesses, and said longitudinal recesses being in a lower part of said lateral wall of the bottle and extending to the vicinity of a support area of said base.

11. A bottle having a rounded bottom and a lateral wall and comprising a separate base attached to it and having a lateral wall surrounding and fixed to a lower portion of said lateral wall of said bottle, an annular support boss, and a bottom part comprising a support area supporting the bottom of said bottle, the bottle further comprising, between said base and the body of the bottle, a passage for heat exchange fluid communicating with the exterior via an inlet area and an outlet area, said fluid passing over part of the bottom of the bottle as it flows through said passage; and further comprising longitudinal recesses extending through an annular area by which said base is fixed to the bottle, said heat exchange fluid passage being formed by said recesses; and wherein said outlet area comprises a plurality of openings in said base.

12. A bottle according claim 11, wherein said inlet area is defined by an upper part of said longitudinal recesses and an edge of said base facing towards said longitudinal recesses.

13. A bottle according to claim 1 or claim 2, wherein said inlet area is entirely in said base.

14. A bottle according to claim 3, wherein said support area comprises an annular curved area bearing the bottom of said bottle body and centering the bottle body relative to the base.

15. A base for a bottle body having a rounded bottom and a lateral wall and adapted to undergo treatment by means of a heat exchange fluid, said base comprising a lateral wall adapted to surround and to be fixed to a lower portion of said lateral wall of said bottle body, an annular support boss, a bottom part comprising a rounded support area adapted to support the rounded bottom of said bottle body, and means, delimited in part by said support area, defining a passage for heat exchange fluid to run over a substantial part of the bottom of the bottle body from an inlet area, for entering heat exchange fluid, to an outlet area, for exiting heat exchange fluid, said inlet and outlet areas being substantially spaced from each other, and wherein said base has an axis and said inlet and outlet areas are in substantial longitudinally spaced relation to the axis.

16. A base according to claim 15, wherein said inlet area comprises a plurality of circumferentially distributed, axially oriented recesses.

17. A base for a container having a rounded bottom and a lateral wall and adapted to undergo treatment by means of a heat exchange fluid, said base comprising a lateral wall adapted to surround and to be fixed to a lower portion of said lateral wall of said container, an annular support boss, a bottom part comprising a support area adapted to support the bottom of said container, and inlet and outlet areas for a heat exchange fluid arranged so that a flow of said fluid through the base passes across the bottom of said container; wherein said inlet area comprises a plurality of circumferentially distributed, axially oriented recesses; and wherein said outlet area comprises a plurality of circumferentially distributed orifices in said support boss.

18. A base according to claim 17, further comprising a fixing area and wherein said support boss comprises a bearing area and extends between said support area and said fixing area, said plurality of orifices extending beyond said bearing area.

19. A base according to claim 18, wherein said axially oriented recesses are all in said lateral wall of said base and pass through an area of greater thickness than the remainder of said lateral wall of said base.

20. A base according to claim 19, wherein the total cross-section of said recesses is less than the total cross-section of said orifices.

21. A base according to claim 20, wherein said support area comprises an annular curved area adapted to lie against the bottom of said container and to center said container relative to the base.

22. A base for a container having a rounded bottom and a lateral wall and adapted to undergo treatment by means of a heat exchange fluid, said base comprising a lateral wall adapted to surround and to be fixed to a lower portion of said lateral wall of said container, an annular support boss, a bottom part comprising a support area adapted to support the bottom of said container, inlet and outlet areas for a heat exchange fluid arranged so that a flow of said fluid through the base passes across the bottom of said container, said outlet area comprising a plurality of circumferentially distributed orifices in said support boss, said base further comprising a fixing area, and said support boss comprising a bearing area and extending between said support area and said fixing area, said plurality of orifices extending beyond said bearing area, and the edge of the lateral wall adjacent the fixing area defining, in part, the inlet area for heat exchange fluid.

23. A base for a container having a rounded bottom and a lateral wall and adapted to undergo treatment by means of a heat exchange fluid, said base comprising a lateral wall adapted to surround and to be fixed to a lower portion of said lateral wall of said container, an annular support boss, a bottom part comprising an area adapted to support the bottom of said container, inlet and outlet areas for a heat exchange fluid arranged so that a flow of said fluid through the base passes across the bottom of said container, said inlet area comprising a plurality of circumferentially distributed, axially oriented recesses, said outlet area comprising a plurality of circumferentially distributed orifices in said support boss, said axially oriented recesses all being in said lateral wall of said base and passing through an area of greater thickness than the remainder of said lateral wall of said base.

* * * * *